US008424679B2

(12) United States Patent
Campbell et al.

(10) Patent No.: US 8,424,679 B2
(45) **Date of Patent: *Apr. 23, 2013**

(54) CARRYING OR STORING DEVICES, SUCH AS GOLF BAGS, HAVING EXTERNALLY ACCESSIBLE STORAGE SYSTEMS

(75) Inventors: Derek Campbell, Portland, OR (US); Lee Dexheimer, Beaverton, OR (US); Chris Pearson, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 84 days.

This patent is subject to a terminal disclaimer.

(21) Appl. No.: 12/947,196

(22) Filed: Nov. 16, 2010

(65) Prior Publication Data

US 2011/0056856 A1 Mar. 10, 2011

Related U.S. Application Data

(63) Continuation of application No. 11/614,388, filed on Dec. 21, 2006, now Pat. No. 7,845,492.

(51) Int. Cl.
*A63B 55/02* (2006.01)

(52) U.S. Cl.
USPC ..... 206/315.5; 206/315.9; 221/307; 224/919

(58) Field of Classification Search ..... 206/315.3, 206/315.5, 315.9, 315.2, 315.6; 224/919; 221/307
See application file for complete search history.

(56) References Cited

U.S. PATENT DOCUMENTS

| | | | | |
|---|---|---|---|---|
| 1,778,225 | A | 10/1930 | Morss | |
| 1,829,093 | A | 10/1931 | Hollins | |
| 1,845,088 | A | 2/1932 | Hunerhoff | |
| 2,664,933 | A | 1/1954 | Gielow | |
| 2,926,713 | A | 3/1960 | Vaughan | |
| 3,215,181 | A | 11/1965 | Reed | |
| 3,848,737 | A | 11/1974 | Kenon | |
| 4,088,251 | A | 5/1978 | Rodriguez | |
| 4,194,648 | A | 3/1980 | Stanton | |
| 4,245,684 | A | 1/1981 | Street et al. | |
| 4,416,404 | A | 11/1983 | Daniels | |
| 4,798,319 | A | 1/1989 | James, Jr. | |
| 4,927,052 | A | 5/1990 | Marthaler et al. | |
| 4,972,948 | A | 11/1990 | Saiki et al. | |
| 5,040,675 | A | 8/1991 | Cleveland et al. | |
| 5,183,154 | A * | 2/1993 | Slemp | 206/315.9 |
| 5,186,374 | A | 2/1993 | Buxton | |
| 5,775,513 | A * | 7/1998 | Anthony | 206/315.3 |
| 6,053,386 | A | 4/2000 | Reynolds | |
| 6,293,397 | B1 | 9/2001 | Chen | |
| 6,357,586 | B2 | 3/2002 | Pratt et al. | |
| 6,439,424 | B1 | 8/2002 | Threadgill, Jr. | |
| 6,481,595 | B1 | 11/2002 | Chilton | |
| 7,111,731 | B2 | 9/2006 | Pratt et al. | |
| 7,845,492 | B2 * | 12/2010 | Campbell et al. | 206/315.5 |
| 2008/0264814 | A1 | 10/2008 | Campbell | |

* cited by examiner

*Primary Examiner* — Sue Weaver

(74) *Attorney, Agent, or Firm* — Banner & Witcoff, Ltd.

(57) ABSTRACT

A golf ball storage system is provided herein. The system may be configured on an exterior of a golf bag and generally includes an upper aperture and a lower aperture that may be substantially vertically aligned. The first and second apertures are connected by an internal sleeve. The sleeve may have a generally tubular configuration to contain golf balls within the storage system in a single file, stacked arrangement. The sleeve may be substantially vertical when the golf bag is in an upright position such that gravity will force balls inserted into the upper aperture to fall to a bottom portion of the sleeve, adjacent the lower aperture, for ease of removal.

26 Claims, 11 Drawing Sheets

CARRYING OR STORING DEVICES, SUCH AS GOLF BAGS, HAVING EXTERNALLY ACCESSIBLE STORAGE SYSTEMS

RELATED APPLICATION

This non-provisional U.S. patent application is a continuation application and claims priority to U.S. patent application Ser. No. 11/614,388 which was filed in the U.S. Patent and Trademark Office on Dec. 21, 2006, and entitled "Carrying Or Storing Devices, Such As Golf Bags, Having Externally Accessible Storage Systems", now U.S. Pat. No. 7,845,492, such prior application being entirely incorporated herein by reference.

FIELD OF THE INVENTION

The invention relates generally to carrying or storing devices, such as golf bags. Carrying or storing devices in accordance with at least some examples of this invention include storage systems (e.g., for golf balls, etc.) that allow users to efficiently insert objects to be stored (e.g., golf balls) and to quickly and easily locate and remove these objects from the storage system.

BACKGROUND OF THE INVENTION

The sport of golf stands as one of the most popular games in the world today. Technological innovations have been regularly improving almost every aspect of the game, including the equipment used to tote the golf clubs both on and away from the golf course. Golf carrying bags that were once made from heavy canvas and steel rods have been replaced by bags made from lighter, more durable composites, metals, plastics, and other materials.

Conventional golf bags often include one or more pockets or compartments in which various golf accessories may be carried. For instance, pockets often are provided to hold golf balls, golf tees, towels, ball markers, rain gear, and the like. Typically, the pockets or compartments are sized to hold a wide variety of different accessories, such as tees, ball mark repair tools, range finders, keys, wallets, money, sunscreen, other personal items, and/or balls. Often, this results in pockets that are oversized or undersized and result in a user "fishing" through one or more pockets to locate the desired item.

In addition, golf bag compartments often are not conveniently positioned on the golf bag. For instance, pockets often are positioned such that a user can not reach one or more pockets when the bag is being carried and/or when the bag is placed on a pull cart or strapped to a motorized golf cart. This requires a user to manipulate the golf bag (e.g., remove it from his shoulder or the cart, shift its location on the shoulder or cart, etc.) in order to access the desired pocket. In addition, the pockets often are arranged such that, should a user be in a position to access a certain pocket while the bag is being carried, the contents of the bag and/or another pocket may spill.

BRIEF SUMMARY OF THE INVENTION

The following presents a simplified summary of the invention in order to provide a basic understanding of some aspects of the invention. This summary is not an extensive overview of the invention. It is not intended to identify key or critical elements of the invention, nor is it intended to delineate the scope of the invention. The following summary merely presents some features and aspects of the invention in a simplified form as a prelude to the more detailed description that follows.

In one arrangement, a golf ball storage system is provided on an exterior of a housing of a golf bag (e.g., integrally formed as part of the golf bag structure, as a separate attachment to the golf bag, etc.). This example storage system may include an upper aperture and a lower aperture that may be substantially vertically aligned (e.g., such that the center of one aperture is offset from the center of the other aperture, in a vertical direction, when the golf bag is arranged at a standing, upright position, by 15 degrees or less, and in some examples, by 10 degrees or less). The first and second apertures of this example structure may be connected by an internal sleeve. This sleeve may have a generally tubular configuration to contain golf balls within the storage system, optionally in a single file, stacked arrangement in a direction from the second aperture toward the first aperture. The sleeve may be arranged so as to be substantially vertical when the golf bag is in an upright position, such that gravity will cause balls to fall toward the bottom of the sleeve to a position adjacent the lower aperture for ease of removal. The sleeve need not extend the entire length between the first and second apertures (in structure where two apertures are present).

In order to store and remove golf balls in golf ball storage systems according to at least some examples of the invention, a user may insert a ball into the sleeve through one of the flexible apertures (e.g., the upper aperture). The aperture may flex or expand to permit the ball to pass through and contract after the ball passes therethrough to prevent the contained balls within the storage system from spilling out. Once the ball is through the aperture, it is contained within the internal sleeve and may be drawn, by gravity, to or toward the lower portion of the internal sleeve, adjacent the lower aperture (or adjacent another ball already located within the sleeve). This process may be repeated to store additional balls in a single-file, stacked configuration.

In order to remove golf balls from the golf ball storage system, a user may insert a finger through the lower aperture to contact a ball. The user then may pull the ball outward, through the lower aperture, causing the lower aperture to flex or expand to accommodate the size of the ball. Once the ball is pulled through the lower aperture, the lower aperture will again contract to ensure that any balls remaining within the storage system do not spill out.

While the above summary primarily relates to systems and methods for storing and retrieving golf balls, those skilled in the art will appreciate that aspects of the present invention may be extended to storage of other objects, such as other balls, etc., including objects of various sizes, shapes, weights, etc.

BRIEF DESCRIPTION OF THE DRAWINGS

A more complete understanding of the present invention and at least some advantages thereof may be acquired by referring to the following description in consideration of the accompanying drawings, in which like reference numbers indicate like features, and wherein.

DETAILED DESCRIPTION OF THE INVENTION

Figure 1:
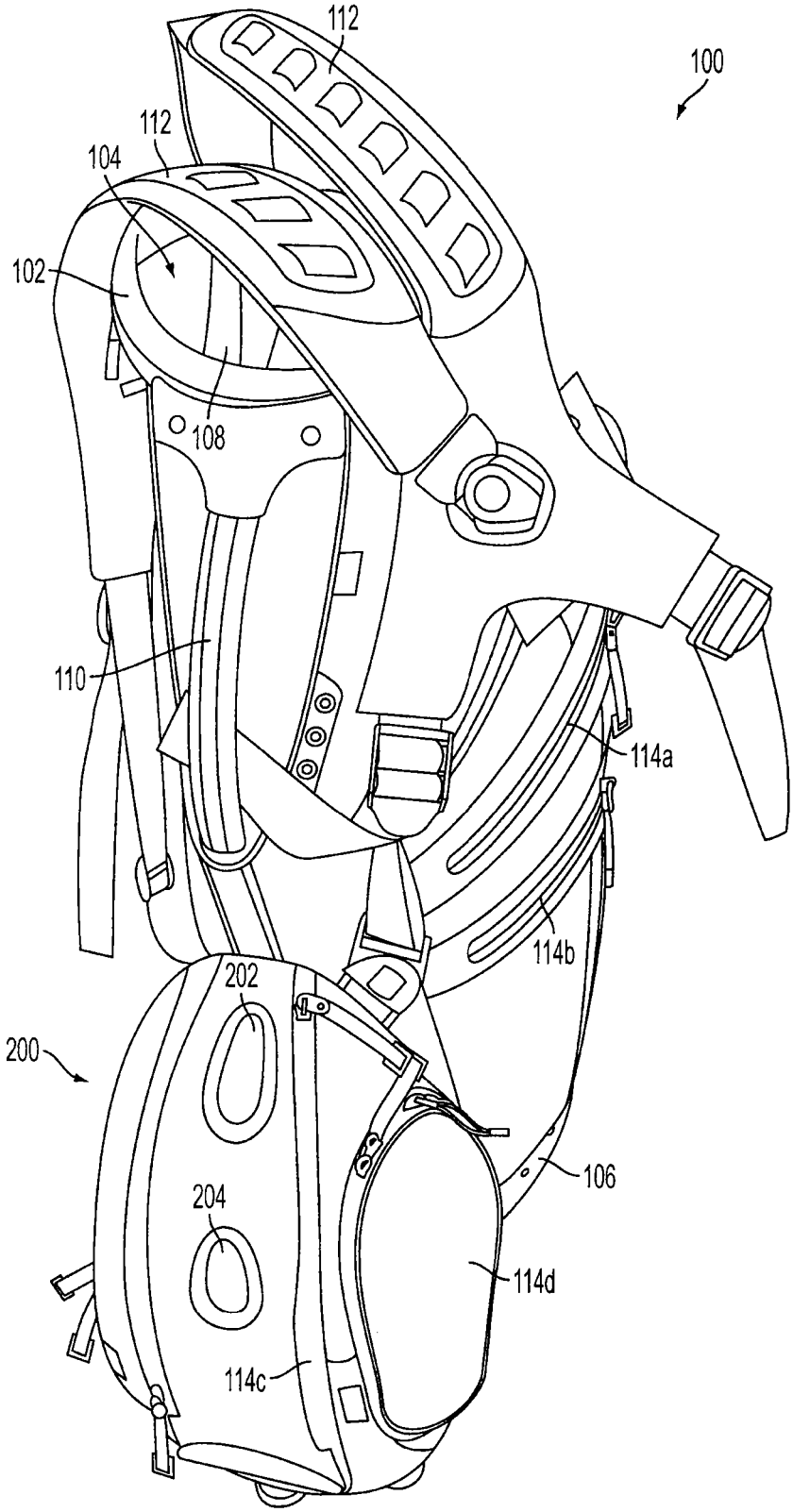
FIG. 1 illustrates an example golf bag structure including one example arrangement of a golf ball storage system according to this invention.

In the following description of various examples of the present invention, reference is made to the accompanying drawings, which form a part hereof, and in which is shown by way of illustration various embodiments in which the invention may be practiced. It is to be understood that other embodiments may be utilized and structural and functional modifications may be made without departing from the scope of the present invention.

I. General Description of Aspects of this Invention

1. Storage Systems for Golf Balls and/or Other Objects

Aspects of this invention relate to carrying or storing devices, such as golf bags for carrying and/or storing one or more golf clubs (e.g., on a golf course, during travel, etc.). Devices according to at least some examples of this invention may include: (a) a housing defining a chamber for at least partially containing one or more objects to be carried or stored (such as golf clubs, other objects for use while golfing, etc.); and (b) at least one compartment arranged on an exterior surface of the housing and/or exposed or accessible from outside of the device. In at least some examples of this invention, this compartment will include a first aperture and a second aperture internally connected to one another by a sleeve (optionally, a tubular or cylindrically shaped sleeve, with a round cross section, in some examples). These apertures may allow easy user access to the contents of the sleeve (e.g., access to one or more golf balls), e.g., without the need for the user to open a zipper or other closure system.

The various apertures may be sized, shaped, and constructed so as to securely hold golf balls (or other objects) in place (e.g., against gravitational forces and/or against other forces to which the carrying device is ordinarily exposed during use, such as forces incident due to walking and/or carrying the device, forces incident during vehicular transport of the device (e.g., on a golf cart, in an automobile, in an airplane, etc.), and the like. In addition, the apertures may be constructed and/or arranged so as to be flexible, expandable, or movable between a contracted position and an expanded position, such that the size of the opening may be altered so as to allow a golf ball (or other object) to be moved through the aperture, e.g., by applying a pulling force, by pushing the object through the opening, and/or when some extra-gravitational force is purposefully applied thereto (e.g., by a user who pushes a golf ball through the aperture and into the sleeve and/or pulls a golf ball through the aperture and out of the sleeve). In some more specific examples, the apertures may be oval, substantially oval, triangular shaped, substantially triangular shaped (e.g., with rounded corners), teardrop shaped, with parabolic shaped ends, elliptically shaped, etc. Also, in some examples, one end or side of the aperture may have dimensions that differ from other sides or ends (e.g., the lower portions of one or both of the apertures may be wider than its corresponding upper portions or vice versa).

The apertures may be provided in a variety of different relative positions with respect to one another without departing from this invention. For example, if desired, when the carrying or storing device is in an upright or vertical position, the apertures may be arranged such that the first aperture is located above the second aperture, optionally vertically aligned, substantially vertically aligned, or at an angle with respect to one another. This arrangement is advantageous, in at least some examples structures according to this invention, so that the golf balls (or other objects being carried) can move under the force of gravity down the length of the sleeve from the first aperture toward the second aperture. Alternatively, if desired, in at least some example structures, the apertures may be arranged horizontally or substantially horizontally with respect to one another.

As another example, golf bag structures according to this invention may include: (a) a housing defining a chamber for holding plural golf clubs; and (b) a golf ball storage compartment provided at an exterior surface of the housing, wherein the storage compartment includes a first aperture and a sleeve extending from the first aperture. This first aperture may define an opening having a longest longitudinal dimension extending in a first direction and a widest transverse dimension extending in a second direction perpendicular to the first direction, wherein, in an unstressed condition (e.g., under normal gravity conditions without an external, extra-gravitational pulling force or pushing force being applied thereto), the longest longitudinal dimension may be at least 1.75 inches (and in some examples, at least 2 inches, 2.25 inches, 2.5 inches, 2.75 inches, or even at least 3 inches) and the widest transverse dimension may be less than 1.68 inches (and in some examples, less than 1.65 inches, less than 1.5 inches, or even less than 1.4 inches). The golf storage compartment may be integrally formed as part of a unitary construction with the golf bag (e.g., as a compartment on the front of a pocket of a golf bag with one or more apertures integrally formed in the golf bag pocket structure and open to the external environment and openly available external to the golf bag). The first aperture may be constructed from appropriate materials, in appropriate arrangements, such that: (a) in the unstressed condition, the aperture opening retains a golf ball within the sleeve against a force of gravity, and (b) when a golf ball located at the opening is exposed to a sufficient external, extra-gravitational pulling force, the opening will expand, flex, or move under the pulling force so as to allow the golf ball to pass through the opening.

As yet another more specific example, golf bag structures according to at least some examples of this invention may include: (a) a housing defining a chamber for holding plural golf clubs; and (b) a golf ball storage compartment provided at an exterior surface of the housing, wherein the storage compartment includes a first aperture and a sleeve extending into the compartment from the first aperture. In these example structures, in an unstressed condition, the first aperture will define an opening having a longest dimension of at least 1.75 inches (and in some examples, at least 2 inches, 2.25 inches, 2.5 inches, 2.75 inches, or even at least 3 inches), but, in the unstressed condition, the opening will be sized, shaped, and/or arranged such that a circle having a diameter of 1.68 inches will not fully fit within the opening (optionally, in some structures, the opening will be sized, shaped, and/or arranged such that a circle having a diameter of 1.65 inches, 1.5 inches, or even 1.4 inches will not fully fit within the opening). Again, this golf storage compartment may be integrally formed as part of a unitary construction with the golf bag (e.g., as a compartment on the front of a pocket of a golf bag with one or more apertures integrally formed in the golf bag pocket structure and open to the external environment and openly available external to the golf bag).

While the golf bags and/or other storage devices described above may have at least two apertures (e.g., one for inserting balls or other objects into the sleeve and one for removing balls or other objects from the sleeve), this is not a requirement in all example structures according to this invention. A single aperture may be provided, in at least some structures according to this invention, and the golf balls (or other objects) may be inserted into and removed from the sleeve through this single aperture. In other words, the sleeve may define a "blind hole" and/or the aperture may simply provide access to a compartment without a definitive elongated "sleeve" structure. The single aperture may have the various dimensional and/or other characteristics and/or features described above. When multiple apertures are present, any individual aperture or desired number of the apertures (including all apertures) in the overall carrying and/or storing device structure may have the various dimensions, characteristics, and/or features described above.

The sleeve extending into the compartment and/or between the apertures (if any) may have a variety of sizes, shapes, and constructions without departing from this invention. As will be explained in more detail below, the sleeve may extend in an axial direction (e.g., away from an aperture, in a direction from the first aperture toward the second aperture, etc.), and the sleeve may be sized so as to define an internal open area perpendicular to the axial direction of at least 2.2 $in^2$, at least 2.3 $in^2$, at least 2.4 $in^2$, at least 2.9 $in^2$, or even at least 3.2 $in^2$. Additionally or alternatively, in at least some examples, the internal open area of the sleeve perpendicular to the axial direction may be less than 20 $in^2$, less than 17 $in^2$, less than 14 $in^2$, less than 9 $in^2$, less than 7 $in^2$, or even less than 5 $in^2$. While it may be rigid and/or straight, optionally, if desired, the sleeve may be flexible, and the axial direction described above need not constitute a straight line (e.g., the cylinder or tubular shape defining the sleeve may be curved or sag, the walls of the sleeve may flex, expand, or move, etc., particularly if no balls are housed therein). In at least some example structures according to this invention, the sleeve cross-sectional area will be selected so as to easily accommodate one ball diameter but to not allow two balls to sit side-by-side in a direction perpendicular to the axial direction (e.g., when multiple balls are present, the sleeve will be sized and arranged so that the balls substantially line up in the axial direction).

The overall sleeve length also may vary widely without departing from this invention (e.g., depending on the number of balls desired to be housed within the sleeve). More specifically, in at least some structures according to this invention, the sleeve will extend in an axial direction (e.g., away from a single aperture, from the first aperture toward the second aperture, etc., optionally in a curved manner) to define a longitudinal length in the axial direction of at least 1.5 inches, at least 1.75 inches, at least 2 inches, at least 2.5 inches, at least 3 inches, at least 4 inches, or even at least 5 inches. Additionally or alternatively, in at least some example structures, the longitudinal length of the sleeve in the axial direction may be made less than 12 inches, less than 10 inches, less than 8 inches, less than 6 inches, or even less than 5 inches. If desired, however, longer sleeve lengths may be used.

When a sleeve member is connected by two substantially vertically (or otherwise) displaced apertures (with the overall device oriented in an upright manner), the distance between the apertures may be selected, at least in part, to limit or control the number of balls to be held in the sleeve (e.g., potentially depending also on the flexibility of the sleeve, length of the sleeve, curvature of the sleeve (if any), etc.). The distance between the lower portion of the upper aperture and the upper portion of the lower aperture may be selected so as to be at least 1 inch, at least 1.5 inches, at least 2 inches, at least 3 inches, or even at least 4 inches. Additionally or alternatively, if desired, this distance may be selected, in at least some example structures according to this invention, so as to be less than 12 inches, less than 8 inches, less than 6 inches, or even less than 4 inches.

Storage compartments in accordance with at least some examples of this invention may be included as part of another element of the overall carrying device structure, such as part of (and integrally formed as a unitary structure with) another pocket member, e.g., for a golf bag. For example, storage compartments as described above may be included as a portion (e.g., on the exterior) of a larger pocket member, wherein the pocket member includes an interior pocket chamber (e.g., for holding tees, ball mark repair tools, sunscreen, etc.). If desired, the sleeve forming part of the ball storage compartment may be maintained separate from this interior pocket chamber (i.e., such that they are not in direction communication with one another). In such structures, the aperture (or both apertures) may be located outside the interior pocket chamber (and optionally directly accessible from the exterior of the golf bag). Alternatively, if desired, one aperture (e.g., the ball insertion aperture) may be located within the interior pocket chamber while the other aperture (e.g., the ball removal aperture) may be located outside the interior pocket chamber (and optionally directly accessible from the exterior of the carrying device). In some examples, if desired, the ball inlet aperture and the ball outlet aperture may be provided on a common surface of the golf bag structure (e.g., formed on or in the bag housing, formed as an exterior-most component of a pocket member, etc.) and/or their openings may generally face the same direction. Other arrangements of the apertures and other pockets or structures provided on the overall carrying or storing device are possible without departing from this invention.

2. Methods of Making and Using Golf Ball and/or Other Storage Systems According to the Invention Further aspects of this invention relate to methods of making carrying or storing devices and/or golf ball storage compartments of the types described above. Such methods may include, for example, providing a housing for carrying and/or storing objects (such as a golf bag for golf clubs) and providing one or more apertures and/or sleeve arrangements of the types described above at an exterior of the housing. The sleeve may be provided, for example, by forming a pocket member for a golf bag in a conventional manner (and/or from conventional materials), and forming an extra sleeve with one or more access openings (i.e., one or more apertures) into, through, or on the pocket member (e.g., using the pocket member wall as at least one wall for the sleeve and/or to define at least a portion of the sleeve). The sleeves, apertures, and/or other features of the carrying or storing device may take on any one or more of the various sizes, shapes, constructions, properties, and/or arrangements described above.

Still additional aspects of this invention relate to storing golf balls or other objects using devices of the types described above. Such methods may include, for example: inserting a golf ball (or other object) into an internal sleeve via a first flexible or expandable aperture (e.g., of the types described above); transferring the golf ball (or other object) from an upper portion of the sleeve to a lower portion (e.g., under the force of gravity, by a pushing force, by inserting another ball, etc.); and removing the golf ball (or other object) from the lower portion of the sleeve via a second flexible or expandable aperture. For devices that include a single aperture, the ball (or other object) may be inserted and removed from the sleeve through the single aperture. The sleeves, apertures, and/or other features of the overall carrying or storing device may take on any one or more of the various sizes, shapes, constructions, properties, and/or arrangements described above.

II. Detailed Description of Example Structures and Methods According to the Invention Specific examples of structures and methods according to the invention are described in more detail below. The reader should understand, however, that these specific examples are set forth merely to illustrate examples of the invention, and they should not be construed as limiting the invention.

FIG. 1 illustrates a golf bag 100 including one example arrangement of a golf ball storage system 200 in accordance with this invention. The golf bag 100 generally includes a housing 102 defining a chamber 104 into which items to be carried, such as golf clubs, may be placed. A base 106 is secured to the housing 102 to provide support and a point of contact between the golf bag 100 and the ground. The base 106 may be arranged to allow the golf bag to stand up substantially vertically, and/or other structures may be provided (e.g., extendable legs, a flexible base member 106, etc.) to enable the bag 100 to be stood up in an angled manner.

Housing 102 is a hollow structure with a generally elongate and tubular configuration for receiving golf clubs. A variety of materials, textiles and the like may form and/or be provided on the exterior of the housing 102 and/or otherwise used in the golf bag construction. A divider 108 is secured at an upper end of the housing 102 in this example structure 100 and defines a plurality of apertures that provide access to chamber 104 and help keep the clubs separated from one another. When in use, shafts of golf clubs extend through the apertures and along the longitudinal length of the housing 102. Heads of the golf clubs remain accessible and generally at the exterior of the golf bag 100. Divider 108 may be used to organize and prevent damage to the golf clubs. In this regard, divider 108 may be formed of a polymer or other material and/or may have a foam and/or textile sheath to provide a yielding and protective surface for contacting clubs. Divider 108 further may include a partition (not shown) that extends between a lower portion of the divider 108 and base 106 to further segregate the volume within the housing 102 and separate the various clubs.

Golf bag 100 also may include a semi-rigid frame that extends between divider 108 and base 106 to provide a supporting structure that retains the generally elongate and tubular configuration of housing 102. The frame may have the configuration of one or more shafts that extend along the side of housing 102. In the upper areas of golf bag 100, if desired, this frame may be exposed and curved to define a handle 110 that assists with carrying golf bag 100 and may provide a point of attachment for one or more shoulder straps 112. The golf bag 100 of FIG. 1 illustrates a two-strap carrying arrangement, however, the golf ball storage system 200 discussed below may be used with any type of carrying arrangement and/or golf bag structure or construction, such as a single strap, cart-type bag, etc. In lower areas of the golf bag 100, the frame may extend into the materials that form the exterior of housing 102. Alternatively, the frame may be curved in the lower area in order to support the shape and limit collapse of the material elements that form pockets in housing 102. That is, the frame may be curved to run adjacent to the exterior of housing 102, thereby providing a rigid structure that assists with retaining the shape of housing 102 or features engaged with the housing 102. Suitable materials for the frame include a variety of polymer materials, graphite, wood, fiberglass, and lightweight metals, such as aluminum, for example. In alternate arrangements, the frame may have the configuration of multiple stay rods that extend between divider 108 and base 106. Other housing 102 and/or frame structures are possible without departing from the invention, including conventional structures and/or constructions as are known and used in the art.

The golf bag 100 of FIG. 1 also includes a plurality of compartments or pockets 114*a*-114*d* distributed around the exterior of the housing 102. The pockets 114*a*-114*d* may vary in size and generally may provide a substantially enclosed region in which various golf accessories, such as golf tees, balls, towels, rain gear, range finders, and the like, as well as personal items, may be stored. The pockets 114*a*-114*d* generally are enclosed on at least one side by a zipper, a hook and loop fastener, a snap fastener, a tie fastener, or other type of fastener or closure system to prevent objects within the pockets 114*a*-114*d* from spilling out.

As noted above, this illustrated golf bag structure 100 further includes an exterior golf ball storage system 200. The golf ball storage system 200 is engaged with or integrally formed with the housing 102 on an exterior portion of the housing 102. The golf ball storage system 200 may be engaged with the housing 102 using any of the various known methods of attachment, such as stitching, adhesives, mechanical fasteners, etc. Alternatively, if desired, the golf ball storage system 200 may be integrally formed as part of the structure making up some portion of the overall golf bag structure 100, such as formed in or on one of the pocket members 114*a*-114*d*, formed in or on the material and/or structures making up the exterior of the housing 102, etc. The golf ball storage system 200 of this specific example structure generally includes an upper aperture 202, a lower aperture 204, and an internal sleeve (206, shown in FIGS. 4-6) connecting the upper and lower apertures 202 and 204, respectively. The various components and structures making up the storage system 200 will be explained in more detail below.

Figure 2:
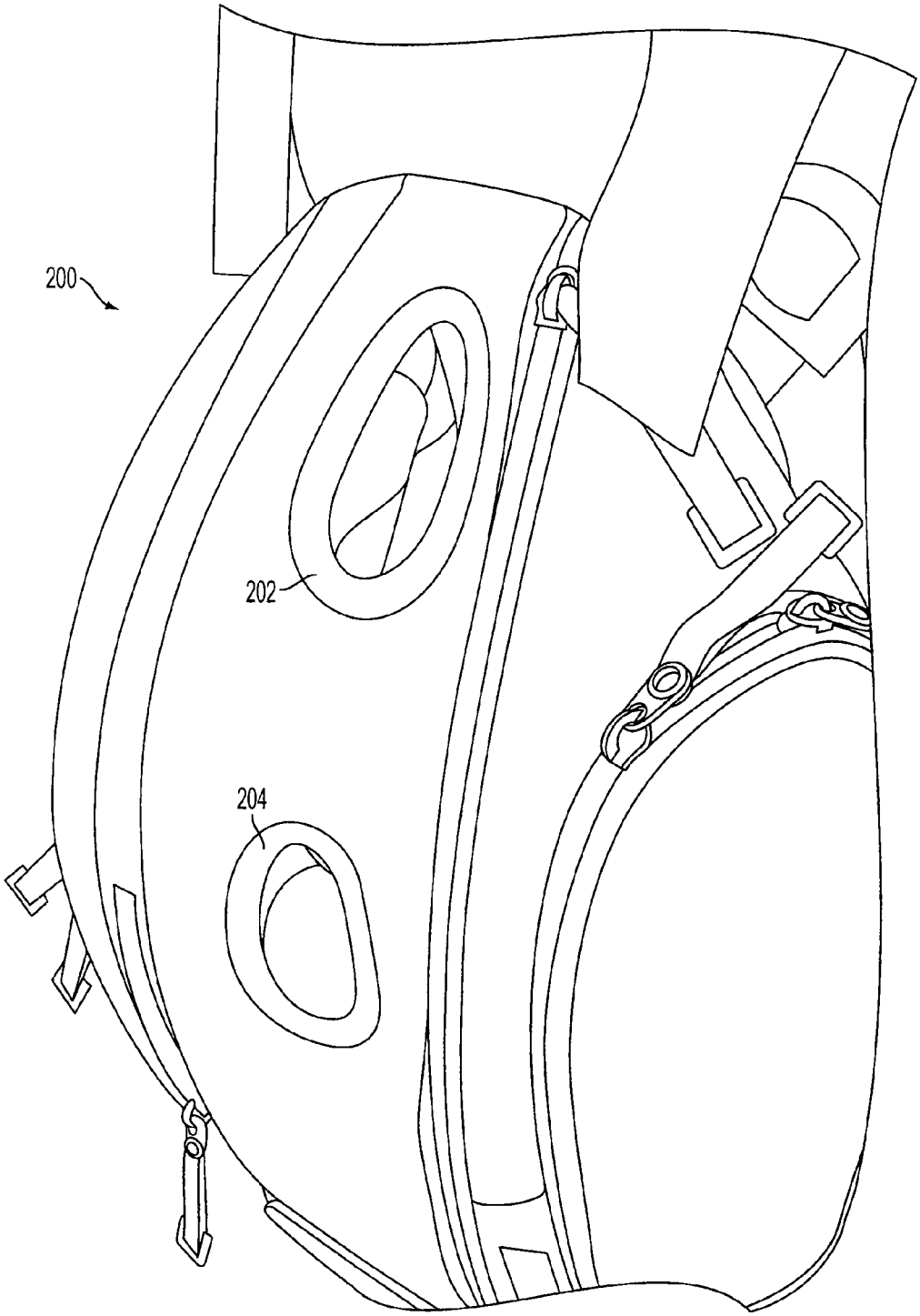
FIG. 2 is a perspective view of the golf ball storage system of FIG. 1.
Figure 3:
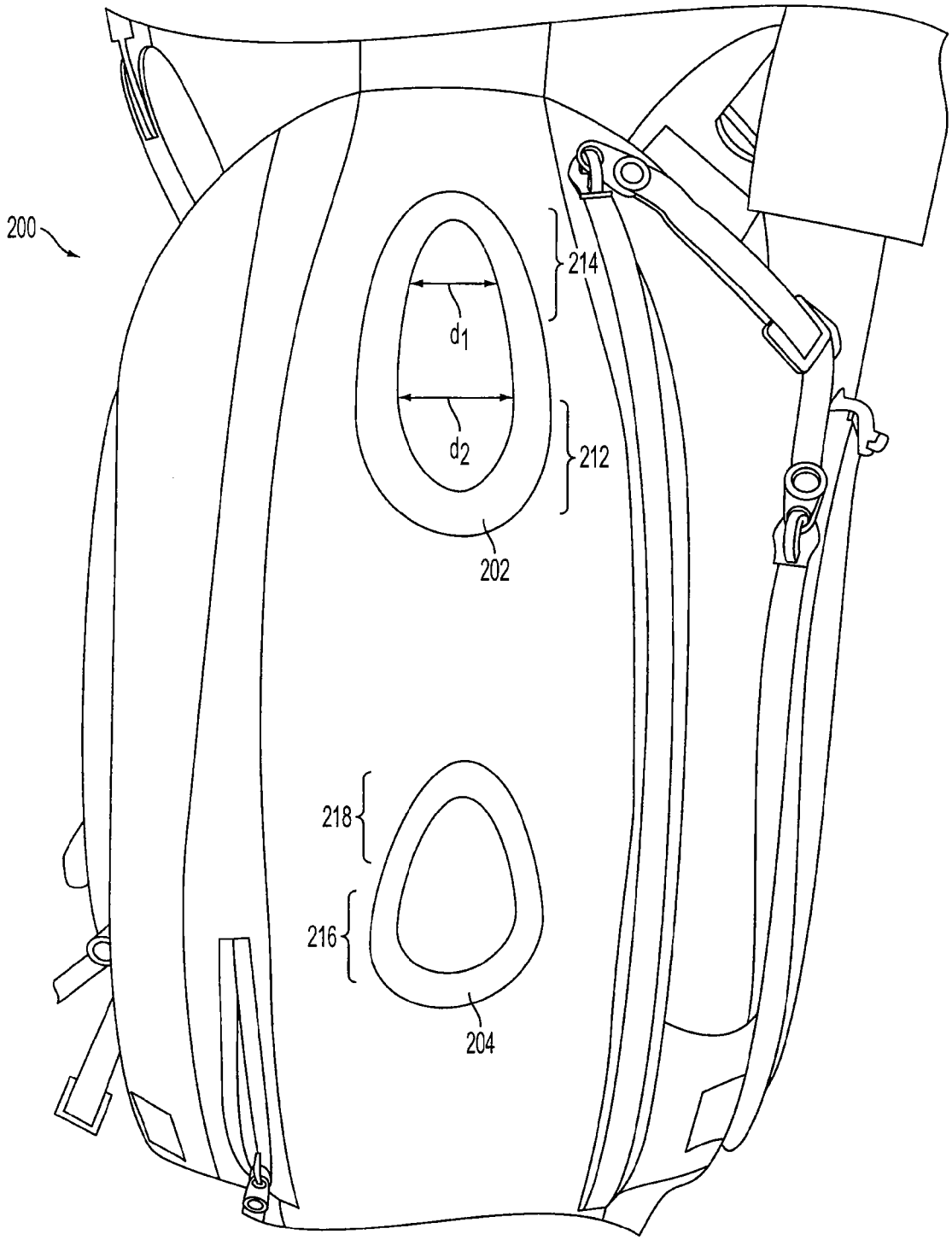
FIG. 3 is an elevational view of the golf ball storage system of FIG. 1.

FIGS. 2 and 3 provide close-up exterior views of the golf ball storage system 200. The upper aperture 202 of this example structure generally is shaped to accommodate the shape and a portion of the size of a golf ball. For instance, upper aperture 202 may be circular, triangular, elliptical, etc. In the arrangement shown, upper aperture 202 is substantially oval in shape or egg shaped. In one arrangement, a lower portion 212 of the upper aperture 202 may be wider than an upper portion 214 of the upper aperture 202. For example, as illustrated in FIG. 3, the width of the upper portion $d_1$ may be narrower than the width of the lower portion $d_2$. This widening of the aperture 202 provides an opening that is sized to fit a golf ball at the lower portion 212 and sized to accommodate the user in inserting the ball at the upper portion 214. For instance, the upper portion 214 may be sized to fit a user's finger such that when a user inserts a ball into the upper aperture 202, the user may place the ball at the lower portion 212 of the upper aperture 202. In doing so, user's finger may extend through the upper portion 214 of the aperture 202 as the ball is pushed through the upper aperture 202.

The shape of the upper aperture 202 also may aid in properly aligning a ball for insertion into the golf ball storage system 200. For instance, a user may place the ball on the upper portion 214 of the upper aperture 202 where the aperture is generally too narrow to accommodate the ball. However, the shape and configuration of the upper aperture may cause the ball to roll or otherwise move downward to the wider, lower portion 212. While the lower portion 212 may be of sufficient width to allow free entry of a ball into the sleeve 206 (e.g., wider than 1.68 inches), alternatively, the lower portion 212 of the aperture 202 may be somewhat smaller than a typical golf ball diameter, but it may stretch, flex, compress, or expand sufficiently to allow the ball to pass into the storage system 200.

In one example arrangement, the upper aperture 202 may be formed, at least in part, from a flexible material in order to allow it to stretch, compress, flex, or otherwise expand when a ball is pushed against it under force, to thereby allow the ball to pass through the aperture 202 and into the sleeve. For example, the outer rim of the aperture 202 may be formed of an elastomeric material (such as rubber, a foam material, etc.) that allows the aperture 202 to compress, flex, and/or move to accommodate the size of the golf ball when a user inserts a ball into the golf ball storage system 200 and contract back to or toward its original size and shape so as to ensure the ball does not fall out of the storage system 200 when the balls are simply being carried in the storage system 200.

The golf ball storage system 200 of this example structure 100 also includes a lower aperture 204, from which golf balls can be removed from the golf ball storage system 200. The lower aperture 204 generally may be any shape to accommodate removal of a golf ball from the golf ball storage system 200. For instance, the aperture 204 may be circular, oval, and the like. In one example, the lower aperture 204 has a somewhat triangular shape having rounded points. This triangular shape provides a relatively wide lower region 216 to allow removal of a ball, as well as a relatively narrow upper region 218 that allows a user to reach a finger, such as his index finger, through the aperture 204 to contact and retrieve a ball. Once the user's finger reaches around and/or contacts the ball on the interior of the storage system 200, the ball can be pulled outward by the user's finger and through the aperture 204.

Similar to the arrangement of the upper aperture 202, the lower aperture 204 also may be formed of a flexible material, such as an elastomeric material (e.g., rubber, a foam material, etc.). This flexible arrangement may allow the lower aperture 204 to flex, stretch, compress, and/or expand to allow the golf ball and/or finger to fit through when a user is attempting to remove a ball, and it will contract when a user is not attempting to access the balls to prevent any balls from spilling out of the golf ball storage system 200. Additional example features and structures of aperture 202 and/or aperture 204, including their flexibility and/or stretchability, will be described in more detail below.

Figure 4:
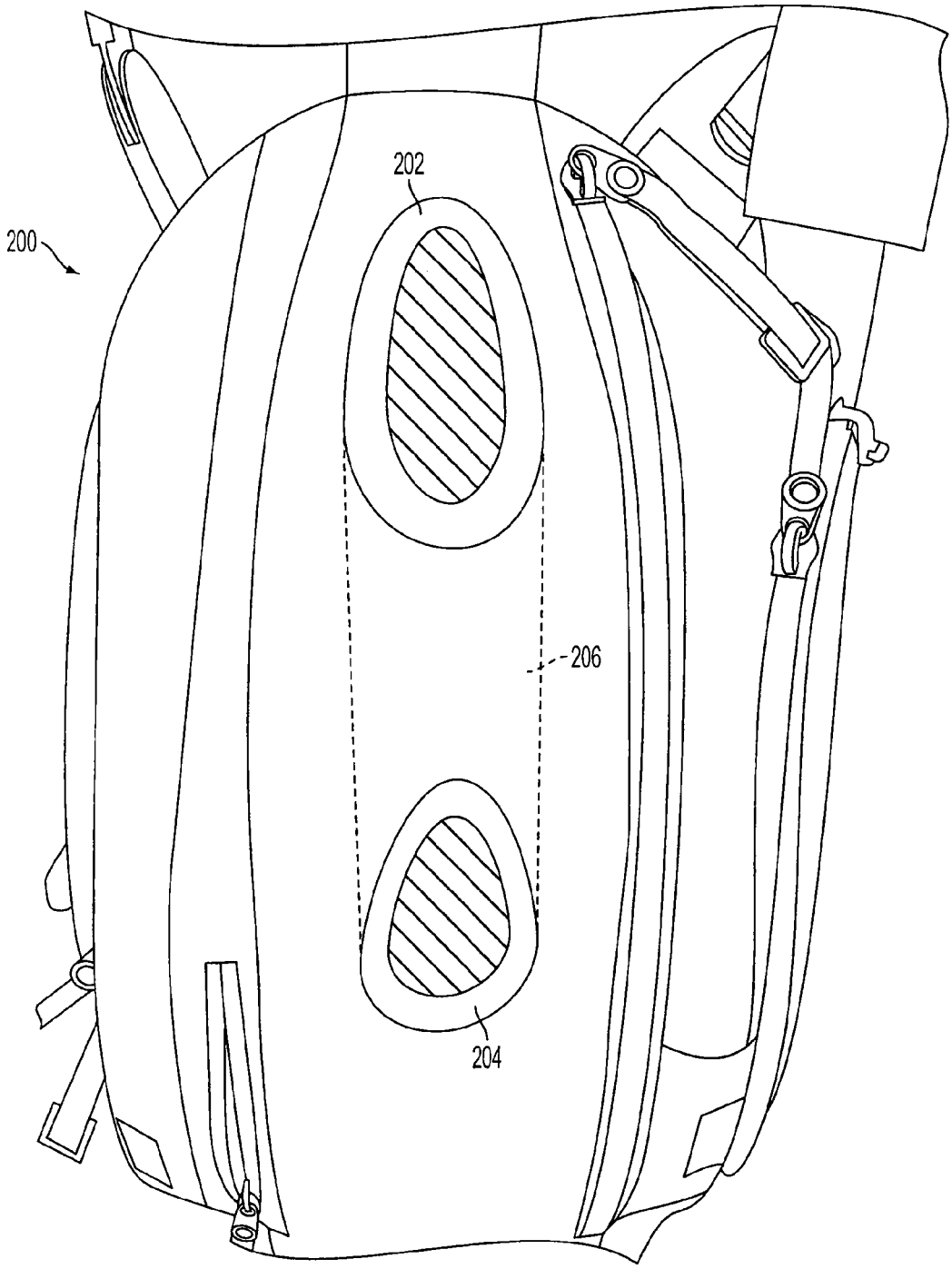
FIG. 4 is the golf ball storage system of FIG. 3 illustrating the interior sleeve.
Figure 5:
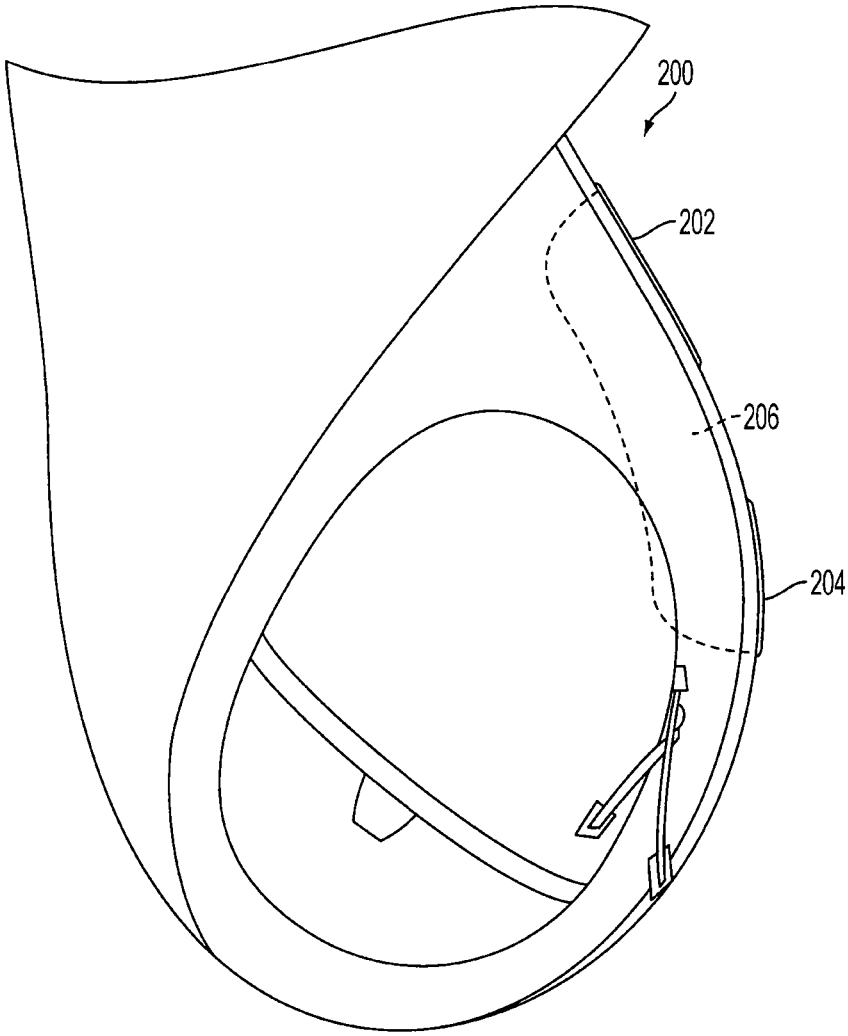
FIG. 5 is a side view of the golf ball storage system of FIG. 1 depicting the interior sleeve.
Figure 6:
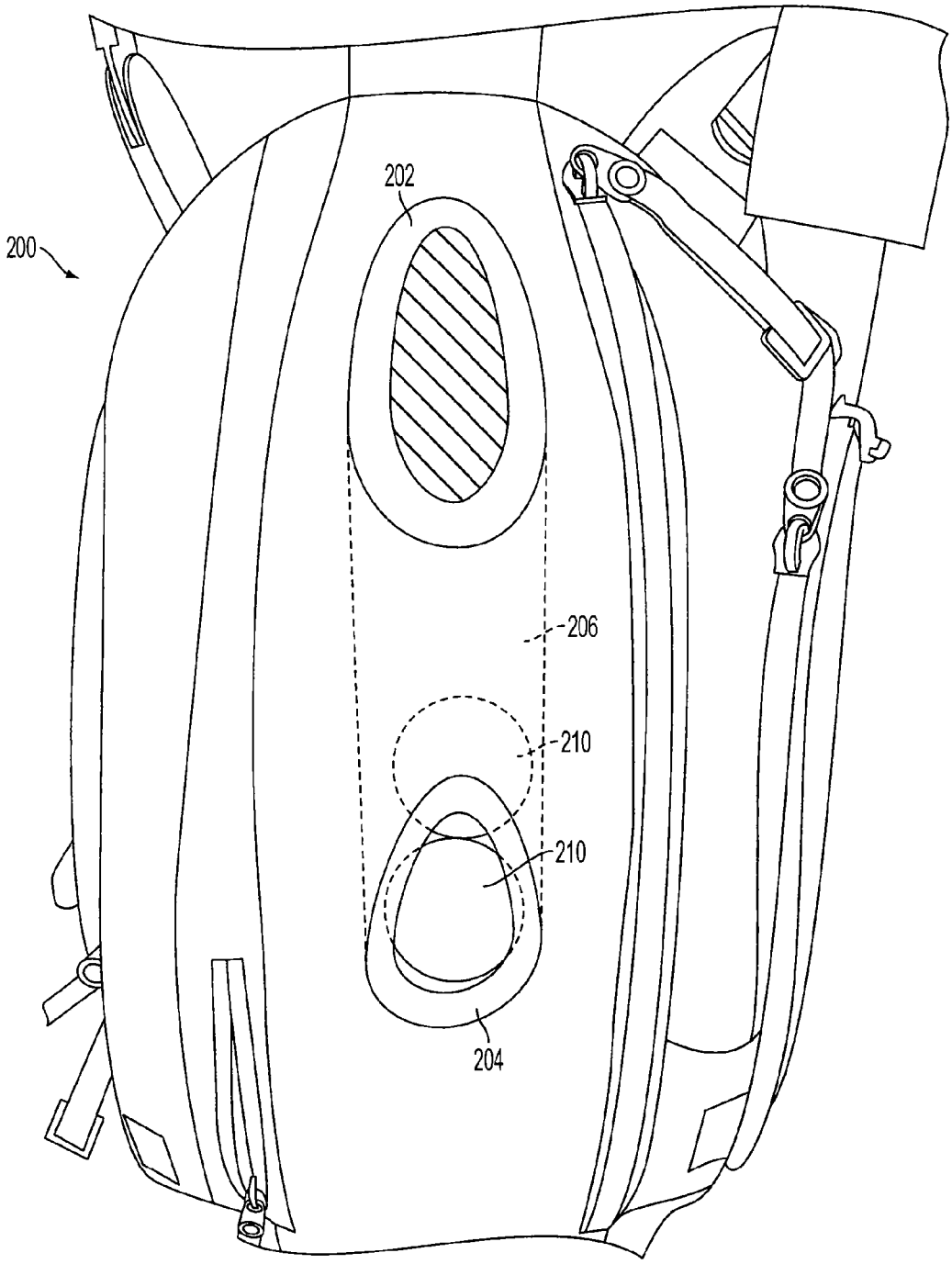
FIG. 6 shows the golf ball storage system of FIG. 1 including the interior sleeve and a plurality of golf balls stored in the golf ball storage system.

Referring now to FIGS. 4-6, additional example features of this example ball storage system structure 200 will be described. As illustrated in these figures, the upper aperture 202 and lower aperture 204 of the golf ball storage system 200 may be connected by an interior sleeve 206 (shown in broken lines in FIGS. 4-6). The sleeve 206 may be arranged so that it is on the interior of the golf bag housing 102, in the interior of a pocket (e.g., pockets 114*a*-114*d*), and/or between the pocket and an outer external material of the golf bag, such that it is generally not visible from the exterior of the bag 100 (the apertures 202 and 204, on the other hand, in this example structure 200, will remain open, visible, and easily accessible from the exterior of the bag 100). The sleeve 206 may have a substantially tubular configuration, e.g., with a round, oval, elliptical, or other cross sectional shape, and it may be sized to accommodate an object with a diameter approximately the size of a golf ball. The sleeve 206 also may be arranged in a substantially vertical configuration (e.g., angled less than 15 degrees, or even less than 10 degrees) when the bag 100 is in a standing and vertically upright position, thereby arranging any balls contained within the holder 200 in a substantially vertical, stacked arrangement. As some more specific examples, the sleeve 206 may have a substantially round cross section, the diameter of that cross section being at least slightly larger than a golf ball, to allow balls to be stored in a single-file, stacked arrangement. The stacked, single-file, vertical arrangement of the balls within the storage system 200 may aid a user in retrieving balls because these balls are contained within a designated ball containing area and within an area allowing minimal movement of the balls. These features may substantially eliminate a user having to search or "fish" through a pocket to locate and remove a ball, thereby speeding play, reducing user frustration, etc.

The sleeve 206 also may be constructed so as to have any desired length (e.g., longitudinal length in the axial direction, as will be explained in more detail below), e.g., within the parameters of the compartment, pocket, or other structure on the golf bag 100 in which it is (at least partially) contained and/or on which it is formed. In the specifically illustrated examples of FIGS. 4-6, the sleeve 206 generally extends between and spans the distance between the upper aperture 202 and lower aperture 204, thereby forming a tubular or cylindrical structure having an axial length. For example, the length of the sleeve 206, and consequently the number of balls the holder 200 can retain, may be determined by the available distance between the upper aperture 202 and lower aperture 204. This feature will be described in more detail below in conjunction with FIG. 10.

The interior sleeve 206 may be formed of any suitable material, such as nylon or other polymeric, textile, and/or fabric materials. In one example arrangement, the interior sleeve 206 may be formed of a water-resistant or waterproof material to prevent moisture from seeping into an interior compartment or pocket or into the interior 104 of the bag through the sleeve 206. More specifically, because the apertures 202 and 204 may remain open and exposed to the external environment, rain or moisture/water from other sources may enter the sleeve 206 through these open apertures 202 and/or 204. Use of a waterproof material within the sleeve 206 can help prevent this moisture/water from further entering the compartment (e.g., a pocket 114*a*-114*d*) or into the housing 102. In addition, the substantially vertical arrangement of the interior sleeve 206, when present in this manner, may prevent rain water and other moisture/water from pooling in the golf ball storage system 200. Rather, any rain water or other moisture/water that may enter the sleeve 206 through the apertures 202 and/or 204 is likely to drain through the lower aperture 204. If desired, a drain mechanism may be provided to further help the sleeve 206 drain.

In order to place a ball 210 into this example golf ball storage system 200, a user may place the ball 210 in contact with the upper aperture 202. The user then may push the ball 210 inward, toward the sleeve 206, which causes the upper aperture 202 to expand or flex and forces the ball 210 through the aperture 202. Once the ball 210 is substantially through the upper aperture 202, the upper aperture 202 will contract and the ball 210 then will be contained within the interior sleeve 206. At this point, gravity may cause the ball 210 to roll or fall from the upper aperture 202, downward through the sleeve 206, to or toward a position adjacent the lower aperture 204, as shown in FIG. 6. The contracted and unstressed position of the lower aperture 204 will keep the ball 210 from falling out of the golf ball storage system 200. Additional balls 210 may be added using this same method. Each ball 210 may be forced through the upper aperture 202 and gravity (or the force of another entering ball) will cause the lower balls to move to or toward a position on top of the balls 210 already in the interior sleeve 206 of the golf ball storage system 200 and to or toward the lower aperture 204.

In order to remove a ball 210 from the golf ball storage system 200, a user may insert his finger into the lower aperture 204 to make contact with a ball 210. The user's finger may force the lower aperture 204 to expand and/or the ball 210 may force the lower aperture 204 to expand in response to the user pulling the ball 210 outward, through the lower aperture 204. Once the ball 210 is substantially through the lower aperture 204, the lower aperture 204 will again contract to prevent any remaining balls 210 in the sleeve 206 from being removed from the holder 200. In addition, the force of gravity will cause any balls 210 remaining in the interior sleeve 206 to move downward, toward the lower aperture 204, so that a user may retrieve the next ball 210 within the golf ball storage system 200, as desired.

In the example arrangement shown in FIG. 1, the golf ball storage system 200 is arranged toward a lower portion of the golf bag 100. This arrangement allows a user to access the balls 210 within the golf ball storage system 200 when the golf bag 100 is upright or slightly inclined from an upright position, for instance, in a free standing position on the ground or in a cart, or when the golf bag 100 is substantially horizontal or angled, such as when a user is carrying the bag on his shoulder, etc. The flexible upper and lower apertures 202, 204 remain in a contracted position to prevent balls 210 from falling out of the golf ball storage system 200. However, a user can easily retrieve a ball 210 from the storage system 200, either when the bag 100 is standing or when the bag is being carried, by inserting a finger into the lower aperture 204 and pulling a ball outward to expand the aperture 204 to accommodate the ball 210.

The golf ball storage system 200 may be located or arranged at any position on the exterior of the golf bag 100. For instance, the holder 200 may be positioned on a lower portion of the golf bag 100, near its bottom. In an alternate arrangement, the golf ball storage system 200 may be arranged at a middle or upper portion of the golf bag 100, near its top. Positioning the golf ball storage system 200 at a lower portion of the golf bag 100 may provide improved access to the balls 210 within the holder when the bag 100 is in a substantially horizontal position, such as when it is being carried by a user. As yet additional alternatives, if desired, the sleeve may extend essentially the entire length of the golf bag 100 and/or it may extend around the circumference of the golf bag 100 (inside or outside), optionally in a spiraled manner. Other configurations also are possible.

While various specific examples of structures, constructions, and features of golf club bags and/or golf ball storage devices in accordance with examples of this invention are described above, those skilled in the art will recognize that numerous changes and modifications may be made to these structures without departing from this invention. Various examples of such modifications are described in more detail below in conjunction with FIGS. 7 through 13.

As described above, the apertures 202 and/or 204 for inserting golf balls into the sleeve 206 and/or for removing golf balls from the sleeve 206 may be made stretchable, expandable, compressible, and/or flexible. In this manner, in their unstressed condition (e.g., when only gravity and/or normal moving forces (e.g., due to walking, carrying the bag, and/or riding with the bag, etc.) are incident on the bag), the aperture(s) will be sufficiently small so as to reliably retain the balls within the storage device, yet they will be readily and sufficiently stretchable, expandable, compressible, and/or flexible so as to allow insertion or removal of balls without undue difficulty (e.g., through positive application of some minimal external force by the user). Any manner of achieving the stretchability, expandability, compressibility, or flexibility may be used without departing from this invention. For example, in some structures, the material forming the border of the aperture 202 and/or 204 will be made from a compressible material so as to allow the force of a pulled or pushed ball to compress the border material a sufficient amount to allow the ball to pass. The compressible material making up the border of the aperture 202 and/or 204 may be, for example, a rubber or foam material, a textile material, other polymeric materials, etc.

Figure 7:
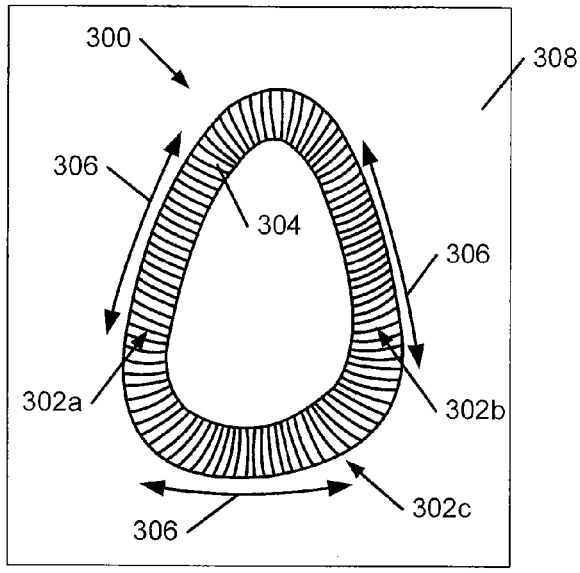
FIG. 7 illustrates additional and/or alternative features of expandable, stretchable, or flexible apertures that may be used in example structures according to this invention.

FIG. 7 illustrates another example aperture structure 300. In this example structure 300, at least some portions of the side walls 302*a*, 302*b*, and/or 302*c* of the aperture 300 have an elastic material 304 included therein or thereon to thereby allow one or more of the walls 302*a*, 302*b*, 302*c* to stretch, e.g., in the direction of arrows 306. The elastic material 304 making up the aperture 300 may be made from a rubber, foam, or textile material, e.g., akin to elastic or rubber stretch bands formed in waistbands, wristbands, or other clothing features. The elastic material 304 need not completely extend around the perimeter of the aperture 300. Rather, one or more expandable sections may be provided around the perimeter, optionally with rigid unstretchable, or slightly stretchable materials around other portions of the perimeter. Any number of elastic or expandable sections may be provided on a given aperture structure 300 without departing from the invention.

As yet another example, if desired, the aperture 300 size may be sufficiently increased simply by providing sufficient slack or flexibility in the outer surface of the material from which the aperture 300 is made. More specifically, as shown in FIG. 7, if the exterior material 308 is sufficiently loose or stretchable, the force bringing a ball into contact with the aperture 300 may be sufficient to cause the aperture walls 302*a*, 302*b*, and/or 302*c* to pull or fold outward or inward (depending on the ball force direction), and thereby opening or increasing the distance between opposing walls a sufficient amount to allow a ball to pass.

Of course, other materials, structures, and/or ways of providing sufficient aperture flexibility, stretchability, compressibility, and/or movement may be used without departing from this invention.

Figure 8:
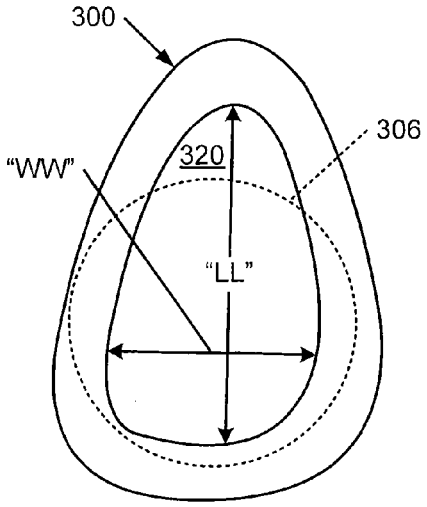
FIGS. 8 and 9 illustrate various example dimensional and/or structural features of expandable, stretchable, or flexible apertures that may be used in example structures according to this invention.

The aperture size may be varied widely without departing from this invention, depending, for example, on the size of the object being stored, the flexibility or compressibility of the material making up the aperture and/or surrounding material, expected temperature range of use, etc. As noted above, desirably, in their unstressed condition (e.g., when only gravity and/or normal moving forces (e.g., due to walking, carrying the bag, and/or riding with the bag, etc.) are incident on the bag), the aperture(s) will be sufficiently small so as to reliably retain the balls in the desired position, yet readily and sufficiently stretchable, expandable, compressible, and/or flexible so as to allow insertion or removal of balls without undue difficulty (e.g., under a positively applied force). For storing golf balls, in accordance with at least some examples of this invention (and as illustrated in FIG. 8), at least one aperture 300 will have its longest dimension (i.e., the longest straight line (or longest longitudinal line "LL") passing through the open area 320 of the aperture 300 of at least 1.75 inches, and in some examples, at least 1.8 inches, at least 2 inches, at least 2.25 inches, or even at least 2.5 inches. If desired, the open area 320 of the aperture 300 will be sufficient so as to allow a user to insert the tip of his/her finger to help grip the ball 322 and pull it outward. In this example structure 300, however, the widest transverse dimension of the open area 320 (i.e., the longest straight line) in a direction perpendicular to the direction of the longest longitudinal line LL (dimension "WW" in FIG. 8) will be less than a diameter of a golf ball (i.e., less than 1.68 inches), and in some examples, it will be less than 1.65 inches, less than 1.6 inches, less than 1.5 inches, less than 1.4 inches, or even less than 1.25 inches. While they may, the longest longitudinal dimension LL of the aperture 300 need not run perfectly vertical, and the widest transverse dimension WW need not run perfectly horizontal. These dimensions may run in any desired directions on the aperture and/or in the overall golf bag structure without departing from this invention.

As shown in FIG. 8, the aperture 300 of this example structure has a longest dimension of at least 1.75 inches, but, as illustrated, the opening 320 of the aperture 300 is sized and arranged such that, in its unstressed condition, a circle having a diameter of a standard size golf ball (e.g., 1.68 inches, represented by ball 322) will not fully fit within the opening 320 at any position.

Figure 9:
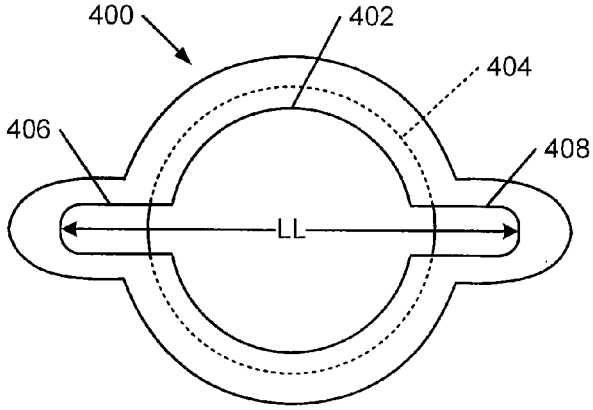

The apertures, however, need not be generally oval, elliptical, or tear-drop shaped, e.g., as shown in various figures above. Rather, any desired aperture structure may be used that has a longest dimension of at least 1.75 inches (optionally with other potential longest dimensions features or ranges, as described above), but with the aperture opening sized and arranged such that, in its unstressed condition, a circle having a diameter of a standard size golf ball (e.g., 1.68 inches, represented by ball 320) will not fully fit within the opening at any position. FIG. 9 illustrates another example aperture structure 400 according to at least some examples of this invention. In this example structure, the aperture 400 generally has a circular structure 402 with a diameter less than that of a standard sized golf ball (represented by ball 404). Other shapes also may be used. In this example structure 400, however, the circular aperture 402 includes two side finger slots 406, and 408 through which a user can reach to help grab the sides of the ball 404. The longest longitudinal length dimension LL in this example structure (from the edge of one finger slot 406, across the central opening, and to the other finger slot 408) is at least 1.75 inches, and in some examples, it may be at least 1.8 inches, at least 2 inches, at least 2.25 inches, or even at least 2.5 inches. The finger slots 406 and 408 may be arranged generally horizontally (as shown in FIG. 9), or they may be arranged at other desired angles without departing from this invention. Also, if desired, the finger slots 406 and 408 need not be precisely aligned, as shown in FIG. 9 (e.g., they may extend from the side edges of the circular region of the aperture at somewhat different angles, on somewhat different lines, etc., without departing from this invention). Of course, other shapes and arrangements for the aperture(s) may be used without departing from this invention.

Figure 10A:
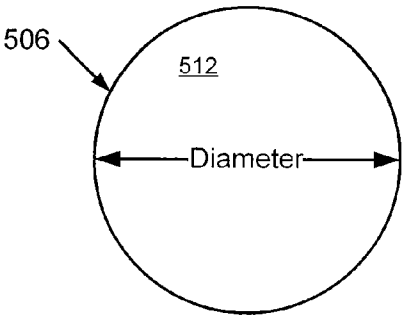
FIGS. 10 through 10B illustrate various example dimensional and/or structural features of apertures and sleeve elements for storing golf balls or other items in accordance with this invention.
Figure 10B:
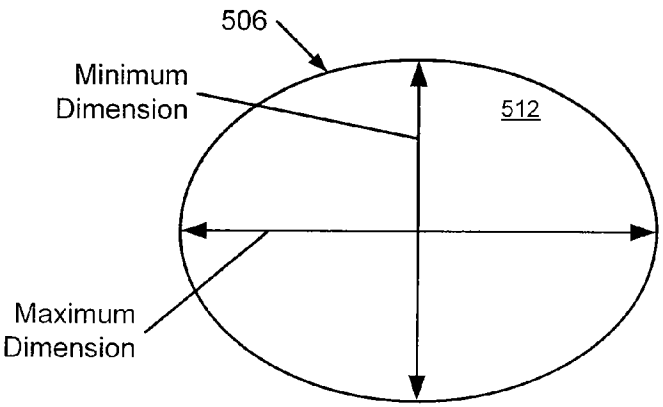
Figure 10:
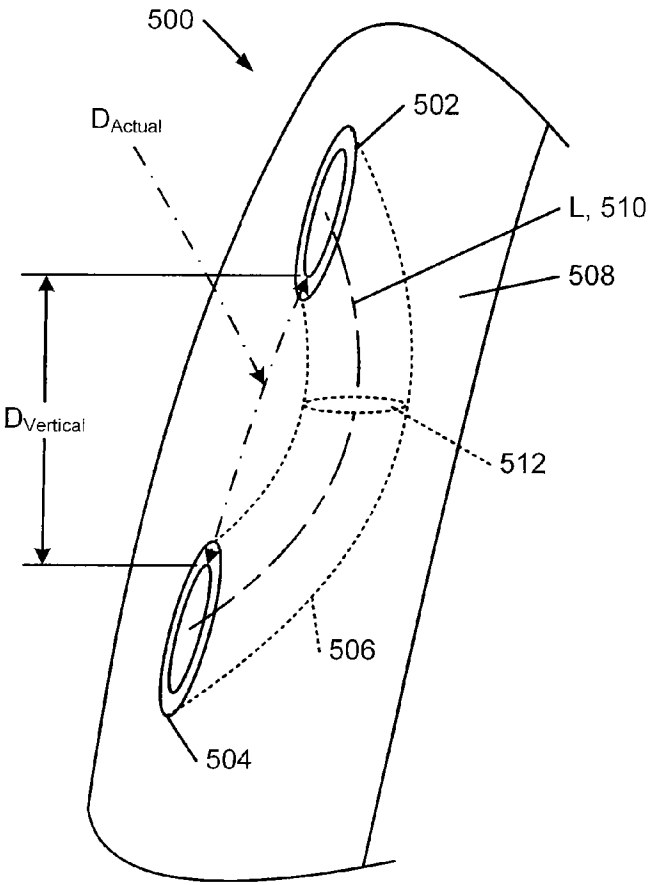

As also described above, the sleeve and apertures for storage compartments in accordance with this invention also may be arranged in a wide variety of different manners and/or with different specific constructions without departing from this invention. FIG. 10 generally illustrates an arrangement of an upper aperture 502 and a lower aperture 504 with a sleeve 506 extending therebetween. In this example structure, the apertures 502 and 504 are integrally formed in the front portion of a pocket member 508, but in at least some example structures, they also may be formed in the golf bag housing member, fixed to an outer surface of a pocket member or a golf bag housing member, or otherwise incorporated into the overall golf bag structure. 500.

The sleeve 506 may be made from one or more pieces of material, and it may be made from at least some materials independent from the golf bag 500 and/or pocket member 508. Alternatively, if desired, at least some portions or even all portions of the sleeve 506 may be made from materials that make up portions of the golf bag housing, the pocket member 508, or other portions of the golf bag structure 500. If desired, the sleeve 506 may be made from a solid and/or relatively rigid material (such as a rigid plastic tube that extends between aperture 502 and aperture 504). Alternatively, if desired, the sleeve 506 (or at least portions thereof) may be made of a flexible material that may sag or droop when nothing is within it to hold it up.

The dimensions of the sleeve 506 may vary significantly without departing from this invention. For example, the sleeve 506 may define a generally cylindrical shape that extends in an axial direction (the "axial direction" being an axis of the cylinder). As shown in FIG. 10, the axial direction may be curved, although it may be made at least partially straight or angled, if desired. In at least some example structures according to this invention, the longitudinal length L of the sleeve 506, as measured along the center line 510 of the sleeve 506 in the axial direction (e.g., the distance the sleeve 506 extends from the center of one aperture 504, along the axial center line 510, to the end of the sleeve and/or to the center of the other aperture 502) may be at least 1.5 inches, and in some examples, at least 2 inches, at least 2.5 inches, at least 3 inches, at least 4 inches, or even at least 6 inches. Additionally or alternatively, in at least some example structures according to this invention, the longitudinal length L of the sleeve, as measured along the center line 510 of the sleeve 506 in the axial direction (e.g., the distance the sleeve 506 extends from the center of one aperture 504, along the axial center line 510, to the end of the sleeve and/or to the center of the other aperture 502) may be less than 12 inches, and in some examples, less than 10 inches, less than 8 inches, or even less than 6 inches.

When tubular or cylindrically shaped, the sleeve 506 may take on any desired diameter and/or cross sectional size. In accordance with at least some examples of this invention, the sleeve 506 may take on a minimum size of at least the size of a standard golf ball diameter ("BD"), and optionally, at least 1.02×BD, at least 1.05×BD, at least 1.1×BD, at least 1.15×BD, and in some examples, at least 1.20×BD. While there is no theoretical maximum size for the sleeve 506, in order to better maintain the balls in an orderly, easily locatable manner, the sleeve 506 in accordance with at least some example structures according to this invention may take on a maximum size of less than 3×BD, and optionally less than 2.5×BD, less than 2×BD, less than 1.75×BD, and in some examples, less than 1.5×BD.

Sleeves 506 also may take on any desired cross sectional shape without departing from this invention. The cross sectional shape, as determined on a plane perpendicular to the axial direction 510, may be round (see FIG. 10A), elliptical (see FIG. 10B), square (optionally with rounded corners), rectangular (optionally with rounded corners), other polygonal shaped, irregularly shaped, etc. Moreover, the cross sectional shape need not remain constant and/or maintain a constant area over the entire longitudinal length L of the sleeve 506 (e.g., for sleeves made with flexible side walls, etc.). Many variations in the sleeve cross sectional structure are possible without departing from this invention.

The following tables provide examples of absolute values for sleeve minimum and maximum dimensions and/or sleeve area for sleeve structures in accordance with some examples of this invention:

TABLE 1

EXAMPLE MINIMUM DIMENSIONS AND MINIMUM CROSS SECTIONAL AREAS OF SLEEVE WITH RESPECT TO BALL DIAMETER ("BD")

| Minimum Sleeve Size | Minimum Sleeve Dimension (e.g., a Diameter) Inches (in) | Minimum Sleeve Dimension (e.g., a Diameter) Millimeters (mm) | Minimum Sleeve Cross Sectional Area Square Inches ($in^2$) | Minimum Sleeve Cross Sectional Area Square Millimeters ($mm^2$) |
|---|---|---|---|---|
| ≧1(BD) | 1.68 | 42.67 | 2.22 | 1430 |
| ≧1.02(BD) | 1.71 | 43.53 | 2.30 | 1488 |
| ≧1.05(BD) | 1.76 | 44.81 | 2.43 | 1577 |
| ≧1.1(BD) | 1.85 | 46.94 | 2.69 | 1731 |
| ≧1.15(BD) | 1.93 | 49.07 | 2.93 | 1891 |
| ≧1.2(BD) | 2.02 | 51.21 | 3.21 | 2060 |

TABLE 2

EXAMPLE MAXIMUM DIMENSIONS AND MAXIMUM CROSS SECTIONAL AREAS OF SLEEVE WITH RESPECT TO BALL DIAMETER ("BD")

| Maximum Sleeve Size | Maximum Sleeve Dimension (e.g., a Diameter) Inches (in) | Maximum Sleeve Dimension (e.g., a Diameter) Millimeters (mm) | Maximum Sleeve Cross Sectional Area Square Inches ($in^2$) | Maximum Sleeve Cross Sectional Area Square Millimeters ($mm^2$) |
|---|---|---|---|---|
| ≦3(BD) | 5.04 | 128.02 | 19.95 | 12,872 |
| ≦2.5(BD) | 4.2 | 106.68 | 13.85 | 8938 |
| ≦2(BD) | 3.36 | 85.34 | 8.87 | 5720 |
| ≦1.75(BD) | 2.94 | 74.68 | 6.79 | 4380 |
| ≦1.5(BD) | 2.52 | 64.01 | 4.99 | 3218 |

As noted above, the sleeves need not have a round cross section. They simply need to be sized such that a golf ball (or other object to be contained) can pass therethrough without difficulty, e.g., under the force of gravity, by one ball (or other object) helping push down another, by a user's finger or hand, etc.

FIG. 10 illustrates another potential feature of aperture arrangements in accordance with at least some examples of this invention. As shown, the lowermost portion of the upper aperture 502 is separated from the uppermost portion of the lower aperture 504 by some distance (labeled $D_{actual}$ in FIG. 10—measured along the surface of the member into and/or on which the apertures are provided, as a direct measurement, etc.). This distance $D_{actual}$ may be at least 1 inch, and in some examples, at least 1.5 inches, at least 2 inches, at least 3 inches, or even at least 4 inches. Additionally or alternatively, if desired, this distance $D_{actual}$ may be less than 12 inches, and in some examples, less than 10 inches, less than 8 inches, less than 6 inches, or even less than 5 inches. The vertical displacement distance ($D_{vertical}$) may be the same as or somewhat less than the actual distances, and the general ranges for this vertical displacement distance may be the same as or somewhat lower than the ranges described above.

Figure 11:
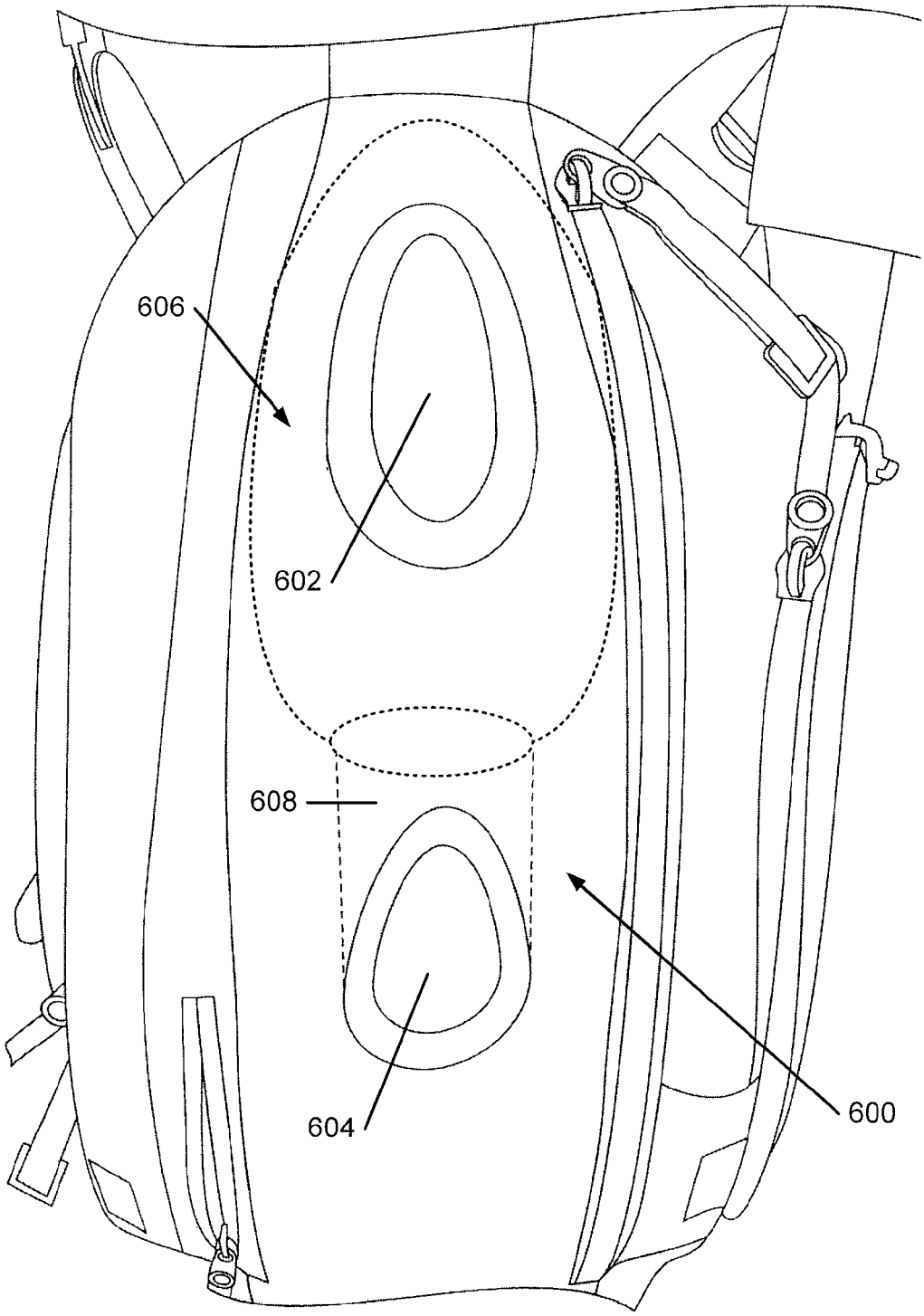
FIGS. 11 through 13 illustrate various alternative arrangements of apertures and/or sleeve elements in golf ball storage systems and/or golf bag structures in accordance with this invention.

Other variations in the overall golf ball storage compartment structure are possible without departing from this invention. For example, a relatively narrow sleeve need not extend the complete distance between the upper aperture and the lower aperture. Rather, as shown in FIG. 11, in the golf ball storage compartment 600 of this example, the upper aperture 602 opens into a relatively large pocket area 606, and this pocket 606 tapers or funnels down to a sleeve portion 608 at a location near the lower aperture 604. In this manner, a relatively large number of balls may be stored (as compared to the narrower sleeve), but the balls still can be readily fed to the lower aperture 604 under the force of gravity and are readily available for use. Any desired volume for the large pocket area 606 and/or tapering/funneling construction may be provided without departing from this invention.

Figure 12:
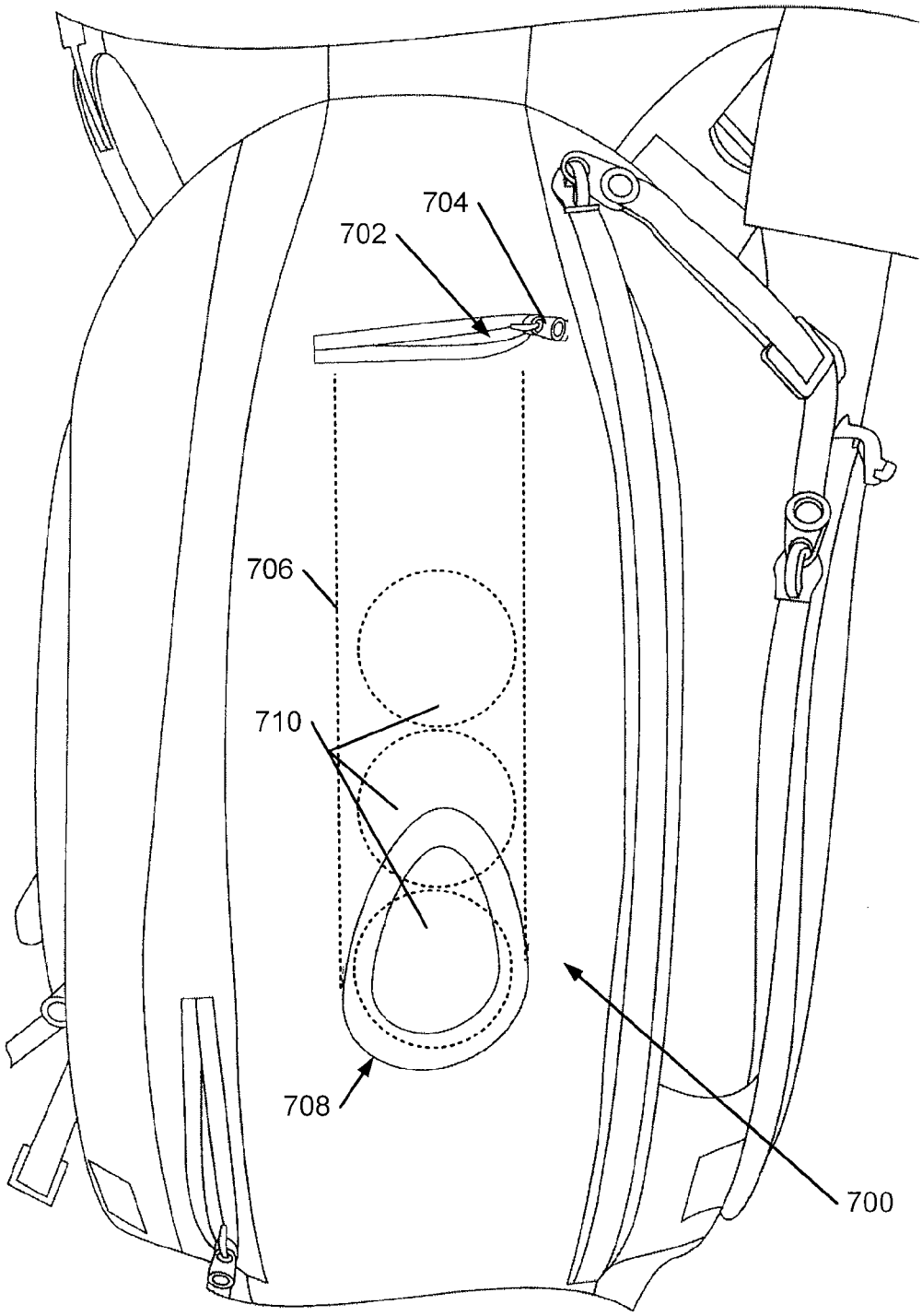

Thus far, all of the illustrated example golf bags and/or golf ball storage system structures have included two open and exteriorly available apertures, one through which balls typically will be inserted into the sleeve for storage and one through which balls typically will be removed from the sleeve for use. These features, however, are not requirements of all example structures according to this invention. For example, as illustrated in FIG. 12, a golf ball storage system 700 in accordance with at least some examples of this invention may include a closed or selectively closable upper aperture (or golf ball inlet aperture) 702. While this illustrated example structure 700 includes the upper aperture 702 closed off by a zippered closure system 704, other ways of closing the aperture 702 may be provided without departing from this invention, such as a flap arrangement (e.g., securing the flap using a snap, hook-and-loop, or other mechanical fastener arrangement, etc.), another mechanical fastener arrangement, etc. As illustrated, the upper aperture 702 provides access to an interior sleeve member 706, which allows balls 710 inserted through the upper aperture 702 to be removed via lower aperture 708, which may have any of the various constructions, structures, etc., as described above.

While FIG. 12 illustrates the zippered closure 704 providing access directly and solely to the interiorly oriented sleeve 706, this is not a requirement. Rather, if desired, zippered closure 704 may provide access to a large pocket element (e.g., for storage of a wide variety of items), and an interior aperture, e.g., on an interior wall forming the larger pocket element (optionally with a separate closure mechanism), may provide access to the sleeve 706. Additionally or alternatively, if desired, the zippered closure 704 may provide access to a large interior ball storage pocket, e.g., of the type illustrated by reference number 606 in FIG. 11, without departing from this invention. As yet another potential alternative, if desired, multiple ball insertion apertures and/or multiple ball removal apertures may be provided and in communication with a single sleeve member without departing from this invention. Of course, a single golf bag structure also may include plural separate and independent golf ball storage systems without departing from this invention.

Figure 13:
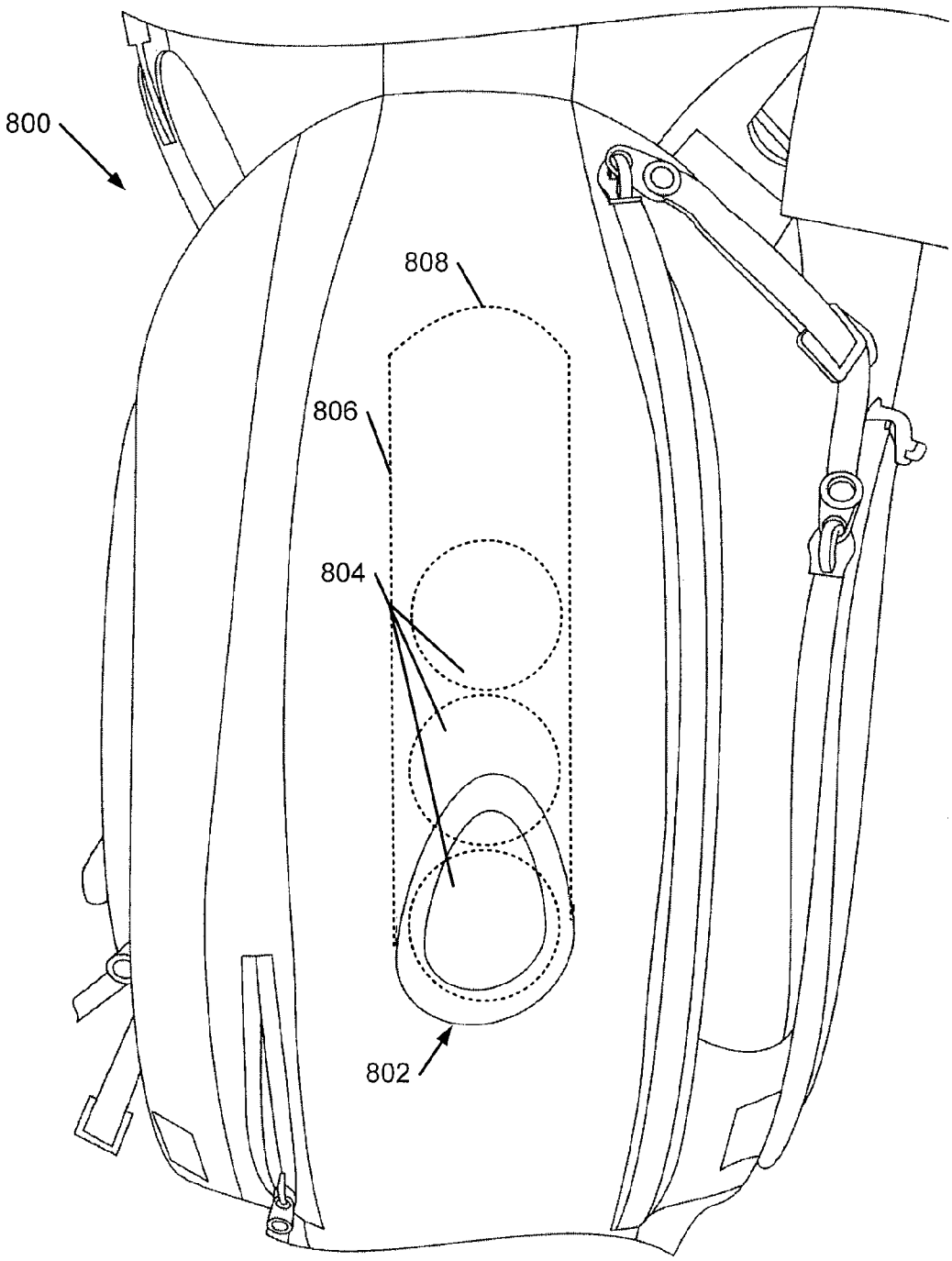

FIG. 13 illustrates yet additional features and/or structures that may be included in golf bags and/or golf ball storage systems in accordance with at least some examples of this invention. Rather than providing both a ball insertion aperture and a ball removal aperture in a golf bag structure, in this example golf bag structure 800 a single aperture 802 (e.g., of the various types described above) is provided, and golf balls 804 may be both inserted into and removed from the storage sleeve 806 through this single aperture 802. As further shown, the sleeve 806 of this illustrated structure is substantially tubular or cylindrical in shape, and it has a closed off upper end 808. This also is not a requirement. Rather, if desired, the upper end of the sleeve 806 could terminate at a larger interior pocket chamber, e.g., of the type illustrated in FIG. 11 by reference number 606, to allow storage of a greater number of balls. Single apertured storage systems of this type may be designed and used to store any desired number of balls without departing from this invention.

Although the golf ball storage systems described above generally are shown as being integrated into the structure of a golf bag, in an alternate arrangement, the golf ball storage system may be an add-on type accessory, e.g., that could be purchased separately from the golf bag (and indeed attachable to any desired object, not limited to a golf bag). In other words, golf ball storage systems of this type may be attached to a golf bag (or to another object, such as a golf cart, pull cart, etc.) as an after-market or other separate piece, e.g., using such known attachment means as buckles, snaps, zippers, hook-and-loop fasteners, retaining member structures, adhesives, cements, and the like.

Additionally, while golf ball storage systems incorporated into or included with golf bag structures are shown and described above, systems and methods according to at least some examples of this invention may be used to store other types of elements, such as other types of balls (e.g., ping-pong balls, tennis balls, baseballs, softballs, racquet balls, etc.); canned or bottled liquids, foodstuffs, or other products; office supplies; other sporting equipment; etc.

III. CONCLUSION

The present disclosure and the accompanying drawings serve to provide examples of various features and concepts related to the golf ball storage system described, not to limit the scope of the invention. One skilled in the relevant art will recognize that numerous variations and modifications may be made to the arrangements described above without departing from the scope of the present disclosure, as defined by the appended claims.

We claim:

1. A golf bag, comprising:

a housing defining a chamber for holding plural golf clubs and including a pocket member defining a substantially enclosed storage region exterior to and separate from the chamber for holding the plural golf clubs; and a golf ball storage compartment integrally formed in the pocket member, wherein the golf ball storage compartment includes a first aperture and a sleeve extending from the first aperture, wherein the first aperture is integrally formed in an exterior surface of the pocket member and defines an opening having a longest longitudinal dimension extending in a first direction and a widest transverse dimension extending in a second direction perpendicular to the first direction, and wherein the first aperture is constructed such that: (a) in an unstressed condition, the opening retains a golf ball within the sleeve against a force of gravity, and (b) when a golf ball located at the opening is exposed to an external, extra-gravitational pulling force, the opening will expand, flex, or move under the pulling force so as to allow the golf ball to pass through the opening.

2. The golf bag of claim 1, wherein the golf ball storage compartment includes a second aperture in communication with the sleeve at an end of the sleeve opposite from the first aperture, wherein the second aperture includes an opening for introducing a golf ball into the sleeve.

3. The golf bag of claim 2, wherein the second aperture is located above the first aperture when the housing is oriented in an upright manner.

4. The golf bag of claim 2, wherein the first aperture and second aperture are substantially vertically aligned when the housing is oriented in an upright manner.

5. The golf bag of claim 1, wherein the sleeve extends in an axial direction from the first aperture, wherein the sleeve defines an internal open area perpendicular to the axial direction of less than 9 int.

6. The golf bag of claim 1, wherein the sleeve extends in an axial direction from the first aperture, wherein the sleeve defines an internal open area perpendicular to the axial direction of less than 7 $in^2$.

7. The golf bag of claim 1, wherein the sleeve extends in an axial direction from the first aperture, wherein the sleeve defines an internal open area perpendicular to the axial direction of at least 2.4 $in^2$.

8. The golf bag of claim 1, wherein the sleeve extends in an axial direction from the first aperture and defines a longitudinal length in the axial direction of at least 1.5 inches.

9. The golf bag of claim 1, wherein the sleeve extends in an axial direction from the first aperture and defines a longitudinal length in the axial direction of at least 3 inches.

10. The golf bag of claim 1, wherein the sleeve extends in an axial direction from the first aperture and defines a longitudinal length in the axial direction of at least 4 inches.

11. The golf bag of claim 1, wherein the sleeve extends in an axial direction from the first aperture and defines a longitudinal length in the axial direction of less than 8 inches.

12. The golf bag of claim 1, wherein the sleeve extends in an axial direction from the first aperture and defines a longitudinal length in the axial direction of less than 6 inches.

13. The golf bag of claim 1, wherein, in the unstressed condition, the longest longitudinal dimension is at least 1.75 inches and the widest transverse dimension is less than 1.65 inches.

14. The golf bag of claim 1, wherein the first aperture has a lower portion that is wider than an upper portion.

15. A golf bag, comprising:

a housing defining a chamber for holding plural golf clubs and including a pocket member defining a substantially enclosed storage region exterior to and separate from the chamber for holding the plural golf clubs; and a golf ball storage compartment integrally formed in the pocket member, wherein the golf ball storage compartment includes a first aperture and a sleeve extending into the compartment from the first aperture, wherein the first aperture is integrally formed in an exterior surface of the pocket member, and wherein, in an unstressed condition, the first aperture defines an opening having a longest dimension of at least 1.75 inches, and wherein, in the unstressed condition, the opening is sized and arranged such that a circle having a diameter of 1.68 inches will not fully fit within the opening.

16. The golf bag of claim 15, wherein the golf ball storage compartment includes a second aperture in communication with the sleeve at an end of the sleeve opposite from the first aperture, wherein the second aperture includes an opening for introducing a golf ball into the sleeve.

17. The golf bag of claim 16, wherein the second aperture is located above the first aperture when the housing is oriented in an upright manner.

18. The golf bag of claim 16, wherein the first aperture and second aperture are substantially vertically aligned when the housing is oriented in an upright manner.

19. The golf bag of claim 15, wherein the sleeve extends in an axial direction from the first aperture, wherein the sleeve defines an internal open area perpendicular to the axial direction of less than 9 $in^2$.

20. The golf bag of claim 15, wherein the sleeve extends in an axial direction from the first aperture, wherein the sleeve defines an internal open area perpendicular to the axial direction of less than 7 $in^2$.

21. The golf bag of claim 15, wherein the sleeve extends in an axial direction from the first aperture, wherein the sleeve defines an internal open area perpendicular to the axial direction of at least 2.4 $in^2$.

22. The golf bag of claim 15, wherein the sleeve extends in an axial direction from the first aperture and defines a longitudinal length in the axial direction of at least 1.5 inches.

23. The golf bag of claim 15, wherein the sleeve extends in an axial direction from the first aperture and defines a longitudinal length in the axial direction of at least 3 inches.

24. The golf bag of claim 15, wherein the sleeve extends in an axial direction from the first aperture and defines a longitudinal length in the axial direction of at least 4 inches.

25. The golf bag of claim 15, wherein the sleeve extends in an axial direction from the first aperture and defines a longitudinal length in the axial direction of less than 8 inches.

26. The golf bag of claim 15, wherein the sleeve extends in an axial direction from the first aperture and defines a longitudinal length in the axial direction of less than 6 inches.

* * * * *

UNITED STATES PATENT AND TRADEMARK OFFICE

CERTIFICATE OF CORRECTION

PATENT NO. : 8,424,679 B2
APPLICATION NO. : 12/947196
DATED : April 23, 2013
INVENTOR(S) : Derek Campbell et al.

It is certified that error appears in the above-identified patent and that said Letters Patent is hereby corrected as shown below:

In the Claim

Column 18, Line 7 (in Claim 5, Line 4):

Please replace "than 9 int." with --than 9 $in^2$.--

Signed and Sealed this
Thirtieth Day of September, 2014

Michelle K. Lee

Michelle K. Lee
*Deputy Director of the United States Patent and Trademark Office*